United States Patent [19]

Lyskawa et al.

[11] Patent Number: 4,545,860

[45] Date of Patent: Oct. 8, 1985

[54] BATTERY OF COKE OVENS AND A METHOD FOR REPAIRING THEM

[75] Inventors: Edmond Lyskawa, Douai; Paul Roger, Dunkerque; Jean Marquis, Lens; Etienne Canivez, Douai, all of France

[73] Assignees: Entreprise Lyskawa S.A.; Union Siderurgique du Nord et de L'est da la France (USINOR) S.A.; Etudes Techniques et Realisations (CdF Ingenierie) S.A., all of France

[21] Appl. No.: 474,012

[22] Filed: Mar. 10, 1983

[30] Foreign Application Priority Data

Mar. 10, 1982 [FR] France ..... 82 04033

[51] Int. Cl.[4] ..... C10B 29/06

[52] U.S. Cl. ..... 201/41; 52/566; 202/139; 202/223; 202/268

[58] Field of Search ..... 201/41; 202/268, 223, 202/139; 52/286, 586, 596, 566, 314, 315

[56] References Cited

U.S. PATENT DOCUMENTS

| | | | |
|---|---|---|---|
| 1,707,858 | 4/1929 | Hurlbert | 52/566 |
| 1,816,322 | 7/1931 | Frinh | 52/566 |
| 2,158,139 | 5/1939 | McIntire | 202/223 |
| 4,059,885 | 11/1977 | Oldengatt | 202/139 |

FOREIGN PATENT DOCUMENTS

| | | | |
|---|---|---|---|
| 228993 | 8/1963 | Austria | 52/586 |
| 812205 | 7/1949 | Fed. Rep. of Germany | 52/586 |
| 2914387 | 10/1980 | Fed. Rep. of Germany . | |
| 674289 | 4/1966 | France | 52/586 |
| 2304660 | 10/1976 | France . | |
| 511310 | 8/1939 | United Kingdom . | |
| 2050586 | 1/1981 | United Kingdom . | |

*Primary Examiner*—Jay H. Woo
*Assistant Examiner*—Michael McGurk
*Attorney, Agent, or Firm*—Finnegan, Henderson, Farabow, Garrett & Dunner

[57] ABSTRACT

A construction for a battery of coke ovens and to a method for repairing them in which a continuous vertical joint plane is provided in the walls of the piers separating the ovens of the batteries, which walls are constructed of courses and headers and stretchers, the plane extending along one of the lateral faces of the headers, with one of the two adjacent stretchers of the course immediately above and below the header being longer than the other stretchers in the wall and the other being shorter so that the joint between them is located in the same vertical plane as the said faces of the headers.

10 Claims, 10 Drawing Figures

FIG. 7
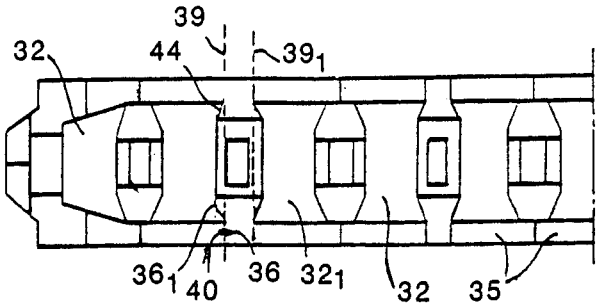
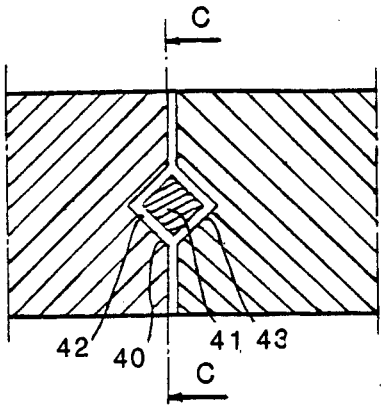
FIG. 8
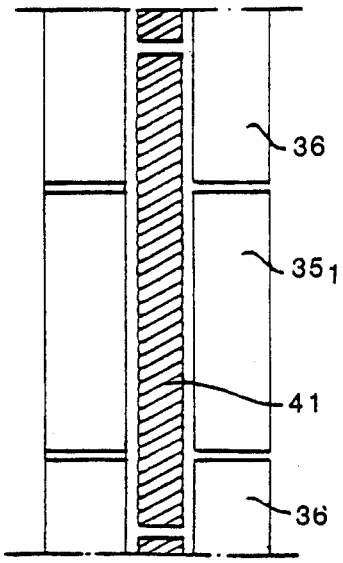
FIG. 9

BATTERY OF COKE OVENS AND A METHOD FOR REPAIRING THEM

BACKGROUND OF THE INVENTION

This invention relates to a battery of coke ovens and to a method for repairing batteries of old coke ovens.

As shown in cross-section in FIG. 1, batteries of coke ovens generally consist of a central coal distillation area 1, a front or machinery area 2 and a rear coke discharge area 3. Central area 1 includes essentially a battery of ovens constructed on a foundation 4 and comprising a regenerator 5 and, at 7, a series of oven cells 8 spaced along in the longitudinal direction. The cells are bounded by piers 9 on each side and extend from the front to the rear of the battery. See FIG. 2.

The oven cells 8 contain the coal to be distilled and have upper inlets 10 for charging coal to the cells from the hoppers 11 of a charger 12, in the case of a gravity charger.

As shown in FIGS. 2 and 3, piers 9 are divided from the front of the battery and towards the rear by a succession of spacer elements 13 forming flues 14 which are supplied with air and a combustible gas. The heat liberated by the combustion of the gas distills the coal in the adjacent oven cells 8.

The front area 2 consists of a discharger 15, movable longitudinally with respect to the oven battery on rails $15_1$. The discharger is provided with a ram $15_2$ movable in the direction of the arrow F, that penetrates through the front opening $8_2$ of each oven cell 8 to push the coke cake out of this cell through the cell's rear opening $8_1$. Movement of the discharger 15 on rails $15_1$ thus permits ram $15_2$ to be positioned opposite the various oven cells in order to push the coke cake out the cell after the distillation of the coal.

The front area 2 also includes, as shown in FIG. 1, a collector 16 for the gas produced during the distillation of the coal, this gas being fed to the collector through a rising column $16_1$ and a cylinder $16_2$.

The rear area of the battery of coke ovens includes a coke guide 17 movable longitudinally on rails $17_1$ so that it can be positioned in front of the rear opening $8_1$ of the oven cell 8 to be discharged. A coke truck 18 is also movable longitudinally along the battery on rails $18_1$ so that, during the discharging of an oven cell 8 by the ram $15_2$, the coke cake is deposited in a layer of uniform thickness on the coke truck 18, which moves in synchronism with the fall of the coke.

The rear area 3 also includes a coke platform 19 onto which the coke in the truck 18 is poured to cool it.

The flues 14 between cell walls 9 are supplied with air and with gas in alternate cycles. The supply of air occurring through the intermediary of the cells of the regenerator so that the air supplying half the flues is heated by the cells of the regenerator which were heated during the previous cycle by the smoke resulting from the combustion of the gas.

The piers 9, alternating with the oven cells 8, are made as shown in FIG. 2, which is a horizontal section along A—A of FIG. 1, and in perspective in FIG. 3.

The piers 9 which separate the oven cells 8 are made of bricks surrounded by a vertical metallic frame 21. The rear openings $8_1$ of the cells 8 have doors 22 which can be opened to discharge the coke cake.

The construction of the piers consists of superposed bricks $23_1$, $23_2$, $23_3$, etc. which form the vertical walls 24 separating the flues 14 from the oven cells 8. Each wall consists of stretchers 25 and headers 26, the stretchers 25 being arranged along the height of the flues 14, whereas the headers 26 extend across the piers on the same course forming the spacers 13. Moreover, the two adjacent stretchers 25 in any one course having their joint plane 27 located in the center of the end faces of the headers 26 in the courses immediately above and below the stretchers.

These coke oven batteries frequently exhibit, after some years of operation, deterioration of the walls 24, both on the rear side (coke side) and on the front side (machine side), and this deterioration extends over a length corresponding to several flues 14.

This deterioration, which includes scaled bricks, exposed joints or cracks at the height of the joints or in the bricks, is due to the repeated thermal shocks, to the deformation of the uprights of the reinforcing frames 21, and to the different expansion of certain parts of the structure which are subject to different temperature conditions.

Attempts have been made to remedy this deterioration by repacking the open joints or by spraying a refractory product onto the walls. Also the ovens have been sprayed with pressurized air laden with fine ceramically bonding dusts, in an attempt to seal or fill up the small cracks.

Eventually, however, the frequency of the necessary repairs is such that, instead of remedying the deterioration, the latter is further aggravated by the repetition of the thermal shocks. Also the ignition of the gases escaping through the doors or through the cracks of the walls creates overheating and aggravates the deformation of the uprights of the frames 21, thus further widening the cracks.

Ultimately one is faced with self-perpetuating deterioration, and then it is necessary to reconstruct the heads of the piers for a length corresponding to several flues on both the coke side 3 and on the machine side 2. Often the repair needed on the coke side is greater than on the machine side because of the abrasion effect of the coke during its discharge and because of the heating of the metallic parts which it causes.

Conventionally, the heads of the piers are reconstructed as follows:

The temperature of the piers 9 to be repaired, and that of the adjacent piers, is lowered to about 1,000° C. The heat is shut off from the flues 14 which are required to be demolished and reconstructed, and the oven cells 8 adjacent to the piers to be repaired are walled up beyond the point at which repair is to be effected relative to the ends of the oven. The flues to be repaired are then demolished while protecting the air and gas inlets from falling rubbish.

If the repairs include that of the roof, the vaults and roof corresponding to the piers to be repaired are likewise demolished. Otherwise, before demolishing the flues, the bracing or the suspension of the vaults is effected.

The ends of the flues are then reconstructed, as shown in FIGS. 2 and 3, or as shown in FIGS. 4 and 5.

According to the first method as shown in FIGS. 2 and 3, cold new stretchers are embedded, at the rate of one course in two, between hot old headers. For example, assuming that the repair is effected up to the line 29 in FIG. 3, cold new stretchers $25_1$ are embedded between hot old headers $26_1$.

However, the ends of the cold new stretchers undergo expansion stresses in the course of its temperature rise as a result of its contact with the hot old headers and the stretchers have a tendency to shift horizontally, and especially vertically. On the other hand the hot old part no longer expands and therefore does not shift. Fresh cracks often then appear in the walls.

To prevent these cracks, it is necessary for each brick to take up its own expansion by compressing its matrix so that its expansion will not react upon adjoining bricks. This does not usually happen, however, and the expansions are mutually cumulative so that the bricks nevertheless undergo stresses due to the aggregate of the individual expansions.

According to the second method as shown in FIGS. 4 and 5, the walls 24 first are cut from top to bottom in a vertical plane 30 that passes through the center of the headers 26.

The end of the pier in front of the plane 30 is then demolished. When it is reconstructed, the hot old part of the wall 24 behind plane 30 and the cold new part in front of it are connected by a smooth vertical joint (30) which then permits the new part of the wall to slide vertically relative to the old part during its expansion. The fluid-tightness of this joint plane is ensured by the application of a refractory product.

However, this second method exhibits considerable disadvantages. The cutting of the pier along plane 30 inevitably shakes the whole pier, which is a complex assembly of bricks joined among themselves by kinds of tenons and mortises. This shaking runs the risk of seriously damaging the stability of the remaining part of the pier, particularly since this part of the structure is no longer in perfect condition.

Furthermore, this second method leads to a weakening of the headers 26, because their width has been reduced by half as a resulting of cutting along plane 30. Also it is extremely difficult to obtain a vertical sliding joint which is fluid-tight. Consequently, it is not possible to completely prevent the escape of gas into the flue or of smoke into the cells which again causes rapid deterioration of the walls and the necessity for persistent, substantial and difficult maintenance.

British Pat. No. 2,050,586 discloses a repairing process for repairing the walls consisting of vertically sawing away the damaged part of the pier along a plane that passes through a lateral face of the headers. Thus adjacent stretchers would be cut along this joint plane, and the part of the stretcher remaining is assembled with a repairing brick provided with an internal overlapping spline.

It is also known by French Pat. No. 2,304,660 to form a vertical joint plane along a vertical alignment of one of the faces of the headers and then to use linking up bricks which form the separation of the two flues adjacent to the joint plane. The stretchers thus do not join each other at the joint plane.

SUMMARY OF THE INVENTION

The present invention has the particular aim of overcoming these disadvantages. It relates to a battery of brick coke ovens conventionally assembled with a bonding material and arranged above a regenerator, the battery having spaced along in the longitudinal direction an alternate succession of oven cells, for holding the coal to be distilled, and of piers supplied with air and gas so that the heat liberated by the combustion of the gas in the piers distills or cokes the coal in the cells. The cells (or ovens) are provided at their upper end with inlets for charging the cells with coal to be distilled, at their rear end with an opening for discharging the coke to a coke guide and truck, and at their front end with an opening for the passage of a ram to push or discharge the coke cake through the rear opening.

Each pier is divided internally and vertically into flues by spacer elements. The walls of the piers, which also are the walls of the adjacent oven cells, are formed by a stack of horizontal courses of bricks equipped with tenons and mortises. Each course includes stretchers arranged opposite the flues, and headers which project out into the course from every other spacer element. Thus two headers in any one course are separated by two adjacent stretchers while the joint of two adjacent stretchers lies opposite a spacer element without a header. The stacked courses are also constructed so that the joint of two adjacent stretchers in a course is located between two headers in the courses immediately above and below the course.

The improvement to the oven battery comprises forming in the walls of the piers, which also form the walls of the oven cells, near at least one of the ends of the cells adjacent to their front and rear openings, a vertical joint plane extending vertically along one of the lateral faces of the headers. One of the two adjacent stretchers of the courses immediately above and below the header is longer than the other stretchers and the other is shorter so that their assembly joint is also located in the same vertical joint plane.

According to another feature of the invention the vertical assembly joint plane is a flat joint assembly having grooves in the adjoining end faces of the bricks and a vertical rod riding in the groove.

According to another feature of the invention, the rod of the flat joint assembly is straight and formed by an element independent of the stretchers and headers. It is housed, with the use of a bonding material, in the vertical grooves formed in the end faces of these stretchers and the lateral faces of the headers adjacent the joint plane.

According to another feature of the invention, the rod is of a refractory material, such as silica or silico-aluminous, the length of which is greater than the thickness of a course of stretchers and headers.

According to yet another feature of the invention, the vertical joint plane is located at the second spacer element of the pier counting from the front and/or rear end of these piers.

DETAILED DESCRIPTION OF THE INVENTION

The invention can best be illustrated by reference to the accompanying drawings, wherein:

FIG. 7 is a plan view of the pier of FIG. 6.

FIG. 8 is a sectional view taken along the lines B—B of FIG. 6 and showing the grooves and rod.

FIG. 9 is a sectional view taken along the lines C—C of FIG. 8.

The aim of the present invention is to construct a new battery of coke ovens, or to repair old batteries, which permit the avoidance of, or at least a substantial reduction in, the damaging effects resulting from the variations in temperatures experienced during repair of a coke oven, which include cracking of the joints, cracking of the bricks, exposure of the joints, etc.

The present invention also permits the use of materials of different types exhibiting different characteristics particularly regarding resistance to thermal shocks or resistance to high temperatures, so as to increase the reliability of the construction.

The present invention also makes it easier to construct and repair oven batteries and facilitates a more fluid-tight joint at the joint of the parts of ovens subjected to different temperature conditions and therefore likely to move relative to each other.

Figure 1:
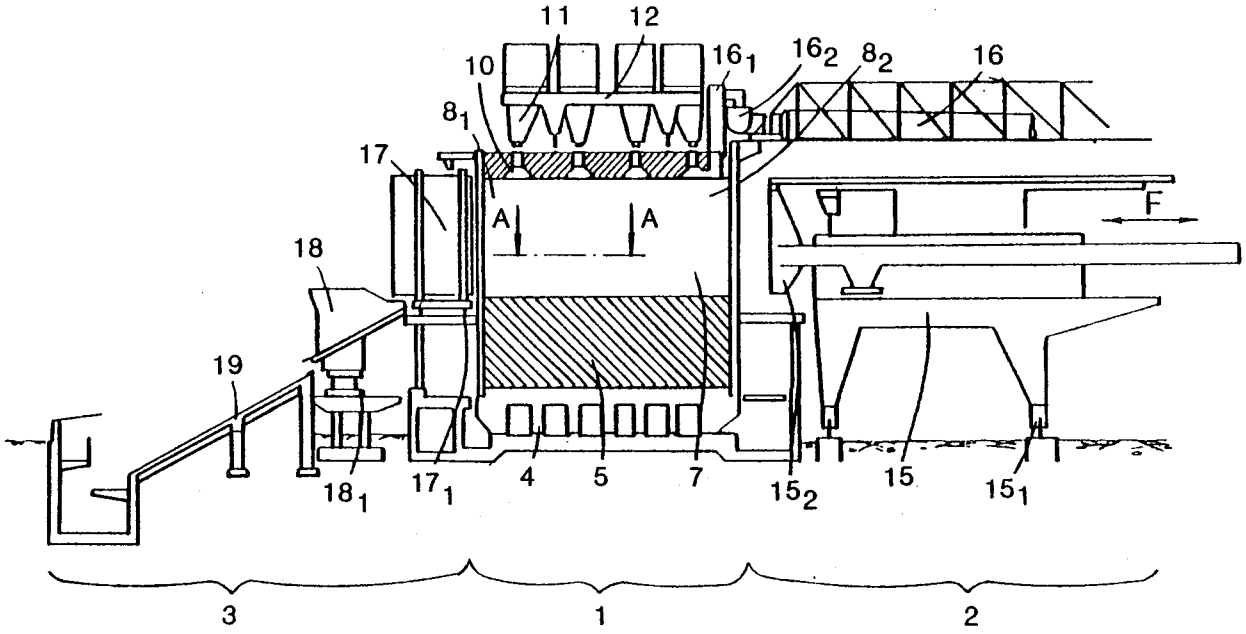
FIG. 1 is a view in schematic cross-section of a conventional battery of coke ovens.
Figure 2:
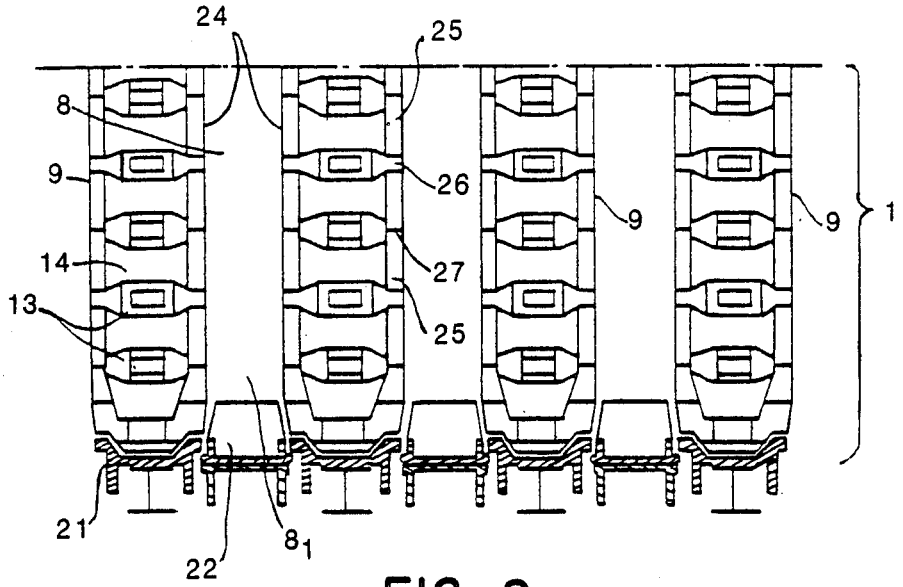
FIG. 2 is a sectional view along the line A—A of FIG. 1 looking in the direction of the arrows.
Figure 3:
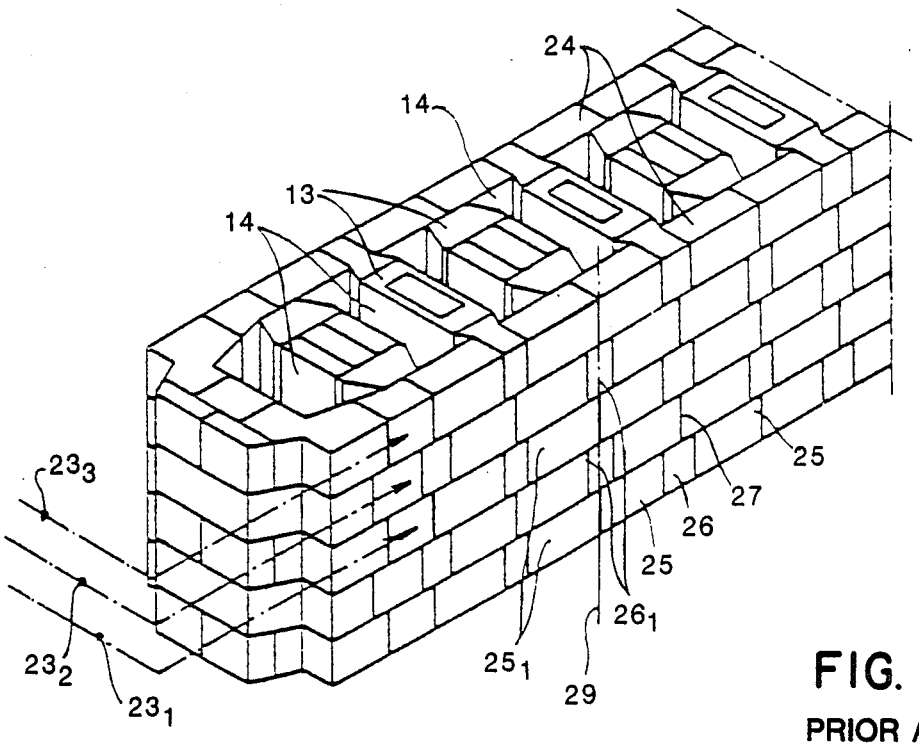
FIG. 3 PRIOR ART
FIG. 3 is a partial perspective view of a conventional pier of a battery of coke ovens.
Figure 4:
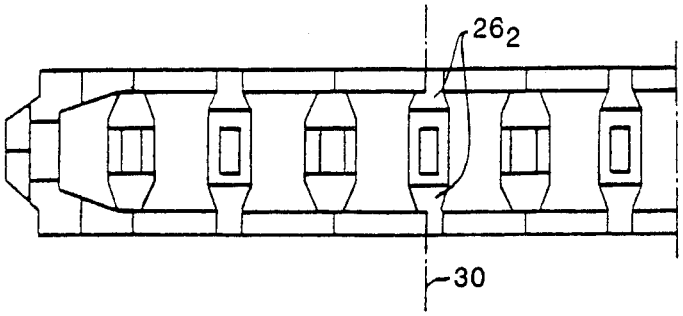
FIG. 4 PRIOR ART
FIG. 4 illustrates, in horizontal section at the level of a joint between courses of bricks, a conventional method for repairing the pier of a coke oven battery.
Figure 5:
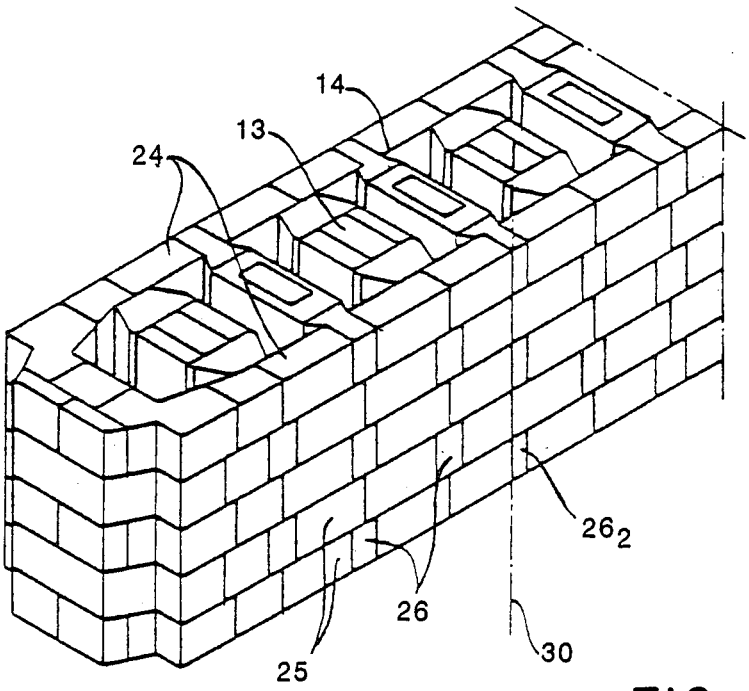
FIG. 5 PRIOR ART
FIG. 5 illustrates in perspective view the method of FIG. 4.
Figure 6:
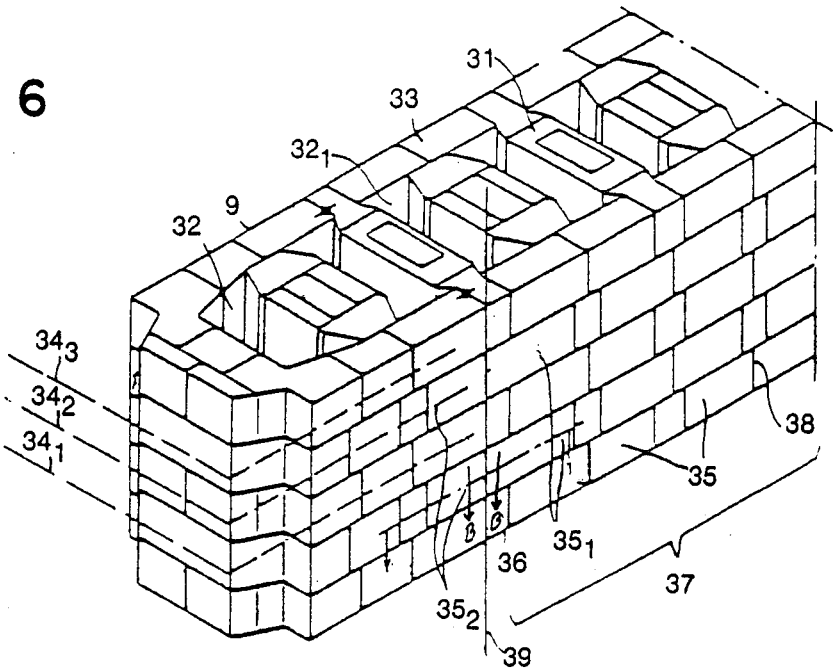
FIG. 6 is a perspective view of a pier constructed according to the invention.

FIGS. 6 and 7 illustrate one of the piers 9 of a battery of coke ovens constructed according to the invention, these piers alternating with the oven cells 8, as shown in FIG. 2.

These piers are divided from front to rear by spacer elements 31 forming the flues 32. The lateral walls 33 of these piers, which also form the walls of the adjacent oven cells 8, are formed by a vertical stack of horizontal courses of bricks $34_1$, $34_2$, $34_3$, etc. Each course is made up of stretchers 35 and headers 36 assembled with a bonding material.

As best shown in FIG. 6, in each course, two consecutive headers 36 are separated by two adjacent stretchers 35, while the joint plane 38 between the two adjacent stretchers is located at the center of the end face of a header in the courses immediately above and below the stretchers.

However, and according to the invention, this structure is modified in the proximity of the one or both ends of piers so as to make a special vertical joint plane 39 to facilitate the eventual repair and reconstruction of the ovens.

For this purpose, and at the location of this vertical joint plane 39, the stretchers $35_1$ adjacent this plane 39 and on the side of the plane opposite from the end of the pier, nearest the plane, have a length greater than normal stretchers 35 so that one of their end faces is located in this joint plane 39.

Likewise, the facing stretchers $35_2$, which are located on the opposite side of the plane, have a shorter length so that one of their end faces is also located in this plane 39.

Thus, in the example illustrated in FIG. 6, vertical joint plane 39 is located along the vertical alignment of the lateral faces of a row of headers 36 and on that side of the headers which faces the end of the pier. The joint plane 39 may likewise, if desired, be located at $39_1$ (See FIG. 7) on the opposite side of the headers 36.

According to the invention and as shown in FIGS. 7 and 8, provision is also made along vertical joint plane 39 for a flat joint assembly 40 comprising grooves in the blocks and a vertical intermediate rod. This permits both parts of the pier, i.e. the new and the old, located on each side of the plane 39, to move vertically as a function of the temperature conditions to which they are subjected, while preserving a fluid-tight joint.

As illustrated in FIGS. 8 and 9, rod 41 of this assembly 40 is straight and is an independent element having, for example, a square cross-section. Rod 41 is housed with a bonding material 42 in recesses or vertical grooves 43 of corresponding shape, and of V-shaped profile in the embodiment illustrated in FIG. 8, which are formed vertically in the mutually opposite end faces of the stretchers or the lateral faces of the headers. This rod, and also the corresponding recesses may be of various geometrical shapes.

Furthermore, and according to the invention, these rods 41 are of a greater length than the thickness of a course $34_1$, $34_2$, $34_3$, etc. That is to say, they are greater than the thickness of a stretcher or of a header and are arranged so that the ends of rod 41 extend into the upper and lower adjacent courses. Preferably, they extend into one half of the adjacent courses. Thus the length of a rod should be equal to twice the thickness of each course. See FIG. 9.

As shown in FIG. 6, joint plane 39 is preferably located at the second spacer element 31 counting from the nearest end of the pier. Joint plane 39 is thus arranged between the zones which during the operation of the ovens are subjected to the most different temperature conditions resulting, for example, from the more intense action of the temperature of the ambient air upon the ends of the piers, or of the more intense cooling of the ends of the piers during the discharge of adjacent oven cells.

Likewise, by this construction and to increase the reliability of the coke oven battery, the inner part of the pier relative to the joint plane 39 may be made with the use of a silicious material highly resistant to high temperatures but less highly resistant to thermal shocks. Whereas, on the contrary, the part of the pier located towards its end relative to this plane 39 can be made of a material less highly resistant to high temperatures but more resistant to thermal shocks (silico-aluminous or other).

To facilitate the placing of the stretchers at the vertical joint plane 39, and likewise in order to increase the lateral stability of the structure, the headers 36 may have stops 44 for positioning the shorter stretchers $35_2$ being used next to them.

According to the present invention, the method may also be used to provide such a similar vertical joint 40 in the piers of an existing battery of coke ovens.

In this case, each pier involved is demolished as far back as the desired location of the vertical joint plane 39. That is to say, just upstream of a spacer element relative to the adjacent end of the oven.

In the first flue $32_1$ retained (See FIG. 6), the heating of which is shut down, longer stretchers $35_1$ are used instead of the existing stretchers. These stretchers are dimensioned so that their end face is oriented towards the end of the pier and is located at the plane 39. In other words at the lateral face of the header facing the pier end in the adjacent upper and lower courses.

A vertical groove of V-shaped profile will have already been cut in the center of the end face of these stretchers that lies adjacent to the joint plane 39.

These cold new stretchers $35_1$, thus embedded in the hot old part, undergo a rapid temperature rise, and the resulting expansion is compensated by a compression of the bonding material separating the courses at the location of these stretchers. This occurs without this expansion affecting the headers and the stretchers of the upper and lower courses. These longer stretchers $35_1$ can consequently be assimilated into the old part of the pier from the standpoint of temperatures and expansion.

In the other courses, a corresponding V-shaped groove is then cut into the lateral face of the header so that the assembly of headers and new stretchers now exhibits, towards the end of the oven and toward the part to be reconstructed, a vertical plane face perpendicular to the wall and containing a groove, for example, of V-shaped profile. This assembly groove will permit the new part to be constructed to cooperate with the old part.

The construction of the new part will then be carried out by alternately using normal stretchers opposite the header and the shorter stretchers $35_2$ opposite the longer stretchers $35_1$ forming the last flue 32 to be replaced (second flue in the example illustrated in FIG. 6).

The end faces of the stretchers which are located at this vertical joint plane are likewise provided with a groove, whether they are normal stretchers or shortened stretchers $35_2$.

As construction proceeds, rod 41 is inserted in the groove with a bonding material so that the joint permits the free vertical expansion of the new part relative to the old part without the new part exerting stresses on the old and while preserving a fluid-tight assembly between these two parts.

In the example described, only a single string of vertical rods is provided along plane 39 for each of the walls 33, but if it should appear desirable, a plurality of parallel vertical rods may be used. In this case these rods would be made of smaller cross-section and of various geometical shapes.

Figure 6A:
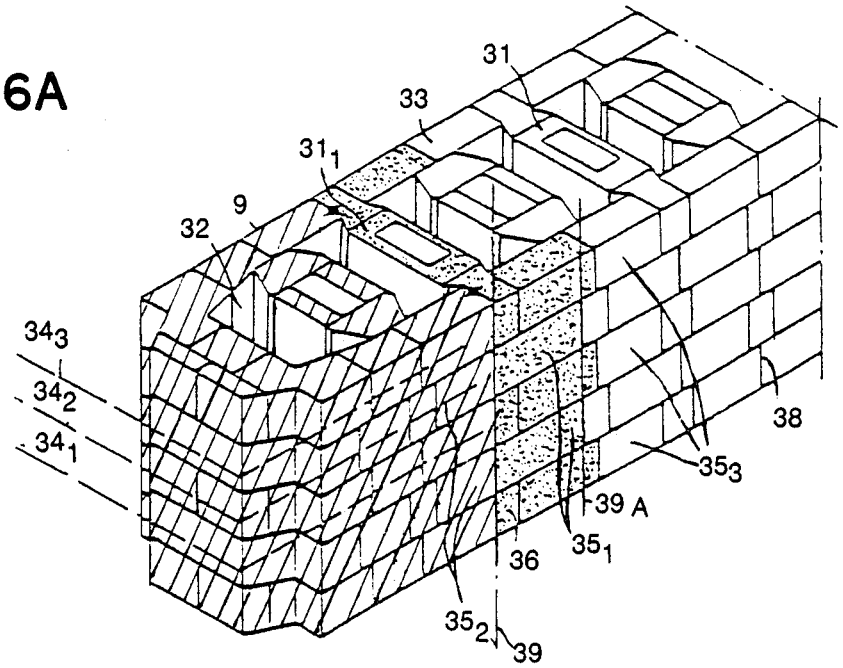
FIG. 6A is a perspective view of a pier also constructed according to an embodiment of the invention.

According to a further embodiment of the invention, and in case the repair should be made as far as plane 39A (See FIG. 6A) where the sliding vertical joint plane is foreseen, but in the case the stretchers $35_3$ could not be removed carefully before their replacement by longer stretchers, then the repair is carried out in a different manner than that described above. All the bricks are carefully removed up to the plane 39A including the stretchers joining the lateral face on the headers in the contempleted plane 39A and those extending back to the brick joint immediately after the plane 39A. Also removed are the spacer elements $31_1$. It will be noted that stretchers $35_3$, headers having a lateral face in the plane 39A and stretchers joining these headers on the other lateral face, are retained. Afterwards the flue immediately preceding the plane 39A (dotted part in FIG. 6A) is reconstructed according to the conventional method of joining with the remaining bricks (that is to say stretchers $35_3$ and headers having a lateral face in plane 39A), except that in every course where the joint between two adjacent stretchers was in the center of the face of a header 36, longer stretchers $35_1$ are used so as to form a sliding joint in plane 39.

During the reconstruction of the last part (hatched part on FIG. 6A), and in the flue adjacent to the sliding vertical joint 39 and opposite each stretcher $35_1$, a shortened stretcher $35_2$ will have to be used to form the wall.

What is claimed is:

1. In a method of repairing a battery of coke ovens having a structure of bricks that provides in the longitudinal direction of the battery an alternate succession of oven cells for holding coal to be distilled and of piers to be supplied with air and gas so that the heat from the combustion of the gas cokes the coal in the cells, the cells being provided at their upper ends with inlets for charging the cells with coal, at their rear ends with an opening for the discharge of the coke and at their front ends with an opening for the passage of a ram to push the coke through the rear openings, and in which each pier is divided internally and vertically into flues by spacer elements, the walls of the piers also constituting the walls of the adjacent oven cells with each wall being formed by a stack of horizontal courses of bricks, each course comprising stretchers arranged adjacent the flues and headers projecting into the course from every other spacer element so that two headers in one course are separated by two adjacent stretchers and with the joint between two adjacent stretchers of a course being located between the headers in the immediately adjacent upper and lower courses and next to a spacer element without headers, the improvement comprising repairing said battery of coke ovens to provide a continuous vertical joint plane in the walls of the piers near at least one of the ends of the cells, said joint plane extending along one of the lateral faces of a header, one of the two adjacent stretchers in the courses immediately above and below said header being longer than the other stretchers and the other being shorter so that their assembly joint is located in the same vertical joint plane as the said one of the lateral faces of said header, said method comprising (a) demolishing the ends of the piers to be repaired as far back as required and to be able to form said vertical joint plane, this vertical joint plane being located along a vertical alignment of one of the lateral faces of a header, (b) removing the stretchers which are located between the header adjacent to this joint plane being removed and replaced by stretchers of greater length so that their end faces will be located in this vertical joint plane, said longer stretchers containing a vertical groove on the exposed face, (c) cutting a cooperating vertical groove in the exposed lateral faces of the headers and in the end faces of the shorter stretchers and normal stretchers required to form this joint plane, and (d) inserting a rod in the groove between the new normal stretchers and headers and between the longer and shorter stretchers.

2. In a method of repairing a battery of coke ovens having a structure of bricks that provides in the longitudinal direction of the battery an alternate succession of oven cells for holding coal to be distilled and of piers to be supplied with air and gas so that the heat from the combustion of the gas cokes the coal in the cells, the cells being provided at their upper ends with inlets for charging the cells with coal, at their rear ends with an opening for the discharge of the coke and at their front ends with an opening for the passage of a ram to push the coke through the rear openings, and in which each pier is divided internally and vertically into flues by spacer elements, the walls of the piers also constituting the walls of the adjacent oven cells with each wall being formed by a stack of horizontal courses of bricks, each course comprising stretchers arranged adjacent the flues and headers projecting into the course from every other spacer element so that two headers in one course are separated by two adjacent stretchers and with the joint between two adjacent stretchers of a course being located between the headers in the immediately adjacent upper and lower courses and next to a spacer element without headers, the improvement comprising repairing said battery of coke ovens to provide a continuous vertical joint plane in the walls of the piers near at least one of the ends of the cells extending along one of the lateral faces of a header, one of the two adjacent stretchers in the courses immediately above and below the header being longer than the other stretchers and said other being shorter so that their assembly joint is located in the same vertical joint plane as the said one of the lateral faces of said header, said method comprising (a) demolishing the ends of the piers to be repaired as far back as required and to be able to form said vertical joint plane, this vertical joint plane being located along a vertical alignment of one of the lateral faces of a header, (b) removing the headers adjacent said vertical joint plane, the stretchers located between them and the stretchers joining the lateral faces of the removed headers opposite said vertical joint plane, (c) removing the spacer elements above and below the removed headers and (d) reconstructing the flue formed by the last removed stretchers, headers and spacers using longer stretchers in every course where the joint between two adjacent stretchers was in the center of the face of a header whereby a vertical plane is provided.

3. In a battery of coke ovens having a structure of bricks that provides in the longitudinal direction of the battery an alternate succession of oven cells for holding coal to be distilled and of piers to be supplied with air and gas so that the heat from the combustion of the gas cokes the coal in the cells, the cells being provided at their upper ends with inlets for charging the cells with coal, at their rear ends with an opening for the discharge of the coke and at their front ends with an opening for the passage of a ram to push the coke through the rear openings, and in which each pier is divided internally and vertically into flues by spacer elements, the walls of the piers also constituting the walls of the adjacent oven cells with each wall being formed by a stack of horizontal courses of bricks, each course comprising stretchers arranged adjacent the flues and headers projecting into the course from every other spacer element so that two headers in one course are separated by two adjacent stretchers and with the joint between two adjacent stretchers of a course being located between the headers in the immediately adjacent upper and lower courses and next to a spacer element without headers, the improvement comprising providing a continuous vertical joint plane in the walls of the piers near at least one of the ends of the cells extending along one of the lateral faces of the headers, one of the two adjacent stretchers in the courses immediately above and below the header being longer than the other stretchers and the other being shorter so that their assembly joint is located in the same vertical joint plane as the said faces of the headers.

4. The battery of coke ovens of claim 3 , wherein a vertical groove is provided in the adjoining faces of the headers and stretchers and the two adjacent stretchers at the continuous vertical joint plane and a rod is located in the groove forming a joint assembly.

5. The battery of claim 4, wherein the rod of the joint assembly is straight and formed by an element independent of the stretchers and headers and is fixed, with the use of a bonding material, in the vertical grooves formed in the faces of the ends of these stretchers and of the lateral faces of these headers.

6. The battery of claim 5, wherein the rod is of refractory material, the length of which is greater than the thickness of a course of stretchers and headers.

7. The battery of claim 6, wherein each rod extends beyond one course and into a part of the immediately adjacent upper and lower courses.

8. The battery of claim 3, wherein the vertical joint plane is located at the second spacer element of the pier counting from either end of the pier.

9. The battery of claim 3, wherein the stretchers, spacer elements with headers and spacer elements without headers forming the part of the piers between the vertical joint plane and the nearest end of the piers, are made of a material having a resistance to thermal shock which is greater and a resistance to high temperatures which is less than that of the material of the stretchers, spacer elements with headers and spacer elements without headers forming the remaining part of the piers.

10. The battery of claim 3, wherein the continuous vertical joint plane extending along the vertical alignment of the lateral faces of headers is located on that side of those headers which faces towards the nearest end of the piers.

* * * * *